US006860401B1

(12) United States Patent
Cattau

(10) Patent No.: US 6,860,401 B1
(45) Date of Patent: Mar. 1, 2005

(54) NEWSPAPER DISPENSER

(76) Inventor: Lyle L. Cattau, 753 SE. 59th Ave., Columbus, NE (US) 68601

( * ) Notice: Subject to any disclaimer, the term of this patent is extended or adjusted under 35 U.S.C. 154(b) by 0 days.

(21) Appl. No.: 10/361,405

(22) Filed: Feb. 10, 2003

Related U.S. Application Data

(60) Provisional application No. 60/356,665, filed on Feb. 13, 2002.

(51) Int. Cl.[7] ..... G07F 11/00
(52) U.S. Cl. ..... 221/75; 221/131
(58) Field of Search ..... 221/75, 82, 69, 221/76, 87, 312 R; 194/292

(56) References Cited

U.S. PATENT DOCUMENTS 4,143,791 A * 3/1979 Bienfait ..... 221/75
4,671,426 A * 6/1987 Grossi ..... 221/75
5,070,986 A * 12/1991 Hoffman et al. ..... 194/237

* cited by examiner

*Primary Examiner*—Kenneth Noland

(57) ABSTRACT

A newspaper dispenser includes a housing with forward and rearward walls and a bottom. A cylindrical coil is rotatably mounted in the housing and projects forwardly from the rearward wall, with newspapers positioned between winds of the coil. A knob on the front of the housing is connected to a drive shaft on the coil to selectively rotate the coil and advance a newspaper forwardly along the bottom wall of the housing. A slot under the forward end of the coil receives a dropped newspaper and dispenses it from the housing.

6 Claims, 3 Drawing Sheets

NEWSPAPER DISPENSER

CROSS-REFERENCES TO RELATED APPLICATIONS

Applicant claims the benefit of U.S. Provisional Application Ser. No. 60/356,665., filed Feb. 13, 2002.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to vending machines and similar dispensers, and more particularly to an improved dispensing apparatus for newspapers and the like.

(2) Background Information

Newspaper vending machines have been known for many years, and come in a wide variety of shapes and sizes. However, there are few single-vend type dispensers that are currently on the market. This is not because single-vend dispensers are unknown, but rather, because the known dispensers simply do not work to the degree necessary to make them economically viable in the marketplace.

The most common dispenser of newspapers is the conventional rectangular box with an operable door in the front. Upon insertion of currency in the machine, the front door is unlocked, and the consumer is able to remove a newspaper. The difficulty with such dispensers is the fact that all of the papers within the machine are available to be taken by a single consumer. In addition, if the door is not closed properly, another consumer can open the door without paying for the paper.

Yet another problem with such dispensers is the issue of security. Because the interior of the conventional dispenser is hidden from view by the paper displayed in the front of the container, the possibility of terrorist activity related to the dispenser has become an issue with such devices in airports and other public places.

BRIEF SUMMARY OF THE INVENTION

It is therefore a general object of the present invention to provide an improved newspaper dispenser for vending single copies of a paper.

A further object of the present invention is to provide a single-vend newspaper dispenser that permits visual inspection of the interior of the cabinet while filled with papers.

Yet another object is to provide a single-vend newspaper dispenser that is simple to operate, inexpensive to construct and has relatively few moving parts.

These and other objects will be apparent to those skilled in the art.

The newspaper dispenser of the present invention includes a housing with forward and rearward walls and a bottom. A cylindrical coil is rotatably mounted in the housing and projects forwardly from the rearward wall, with newspapers positioned between winds of the coil. A knob on the front of the housing is connected to a drive shaft on the coil to selectively rotate the coil and advance a newspaper forwardly along the bottom wall of the housing. A slot under the forward end of the coil receives a dropped newspaper and dispenses it from the housing.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
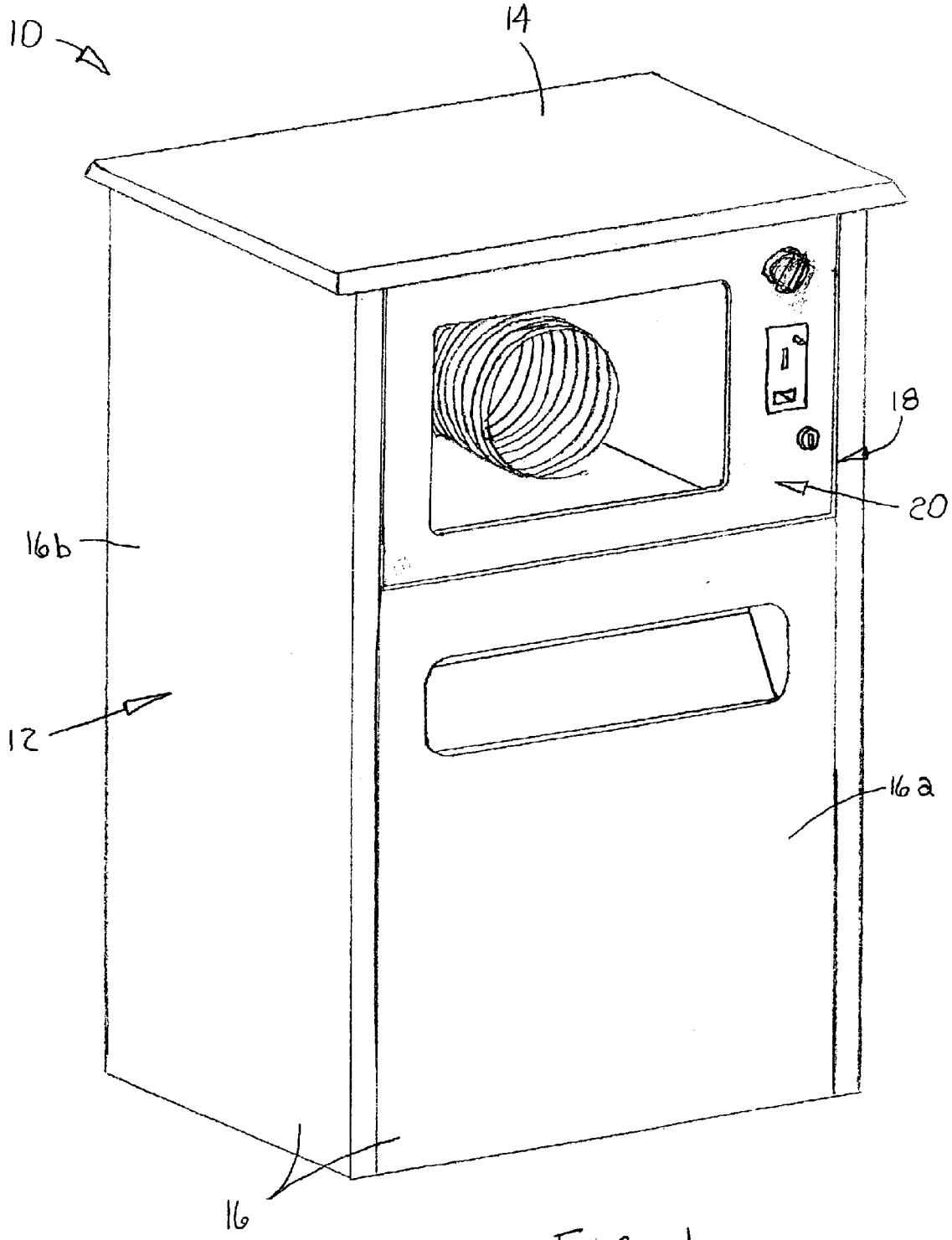
FIG. 1 is a perspective view of the newspaper dispenser of the present invention.
Figure 2:
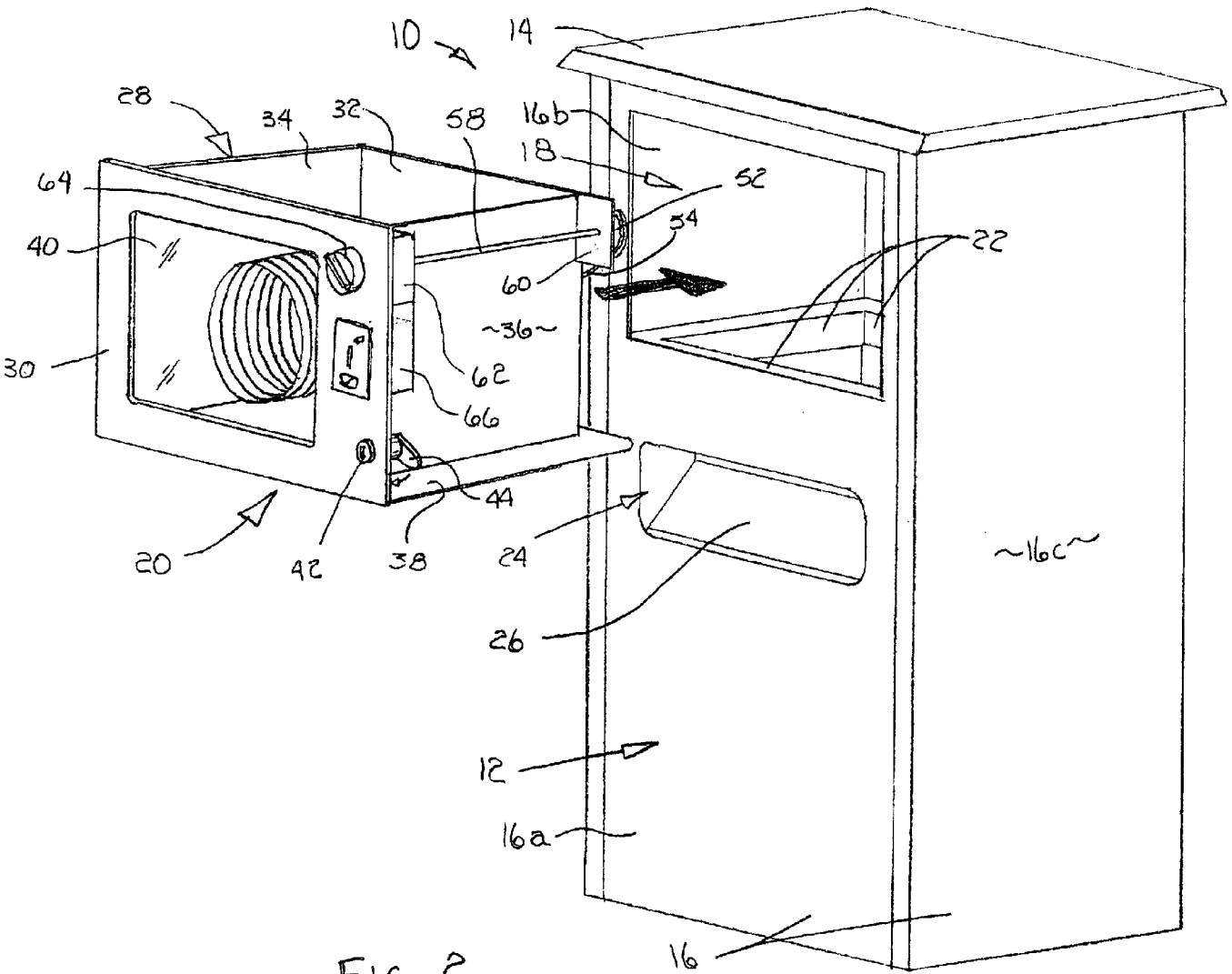
FIG. 2 is a perspective view of the dispenser, taken from the right front side and with the dispensing assembly removed from the dispenser cabinet.

Referring now to the drawings, in which similar or corresponding parts are identified with the same reference numeral, and more particularly to FIGS. 1 and 2, the newspaper dispenser of the present invention is designated generally at 10 and includes an upright cabinet 12 having a top 14 and a plurality of vertical sidewalls 16. The front sidewall 16*a* includes a large opening 18 (shown in detail in FIG. 2) in the upper end, for the removable insertion of the dispensing assembly 20 of the invention within cabinet 12.

As shown in FIG. 2, a plurality of support brackets 22 are mounted on the interior faces of sidewalls 16 proximal and below opening 18, to support dispensing assembly 20 within cabinet 12. An opening 24 in front wall 16*a*, spaced below large opening 18, provides access to a dispensing chute 26 upon which a paper will be dispensed from cabinet 12.

Dispensing assembly 20 includes an open-topped box-shaped housing 28 with a forward wall 30, rearward wall 32, bottom wall 34 and opposing sidewalls 36 and 38. Bottom wall 34 projects horizontally forwardly from rearward wall 32 but does not reach forward wall 30. Thus bottom wall 38 provides a support surface for housing 28 on support brackets 22. Housing forward wall 30 includes a large clear window 40, so that the front of a paper within the housing 28 is viewable from the front of cabinet 12.

A conventional cylinder lock 42 having an operable arm 44 is mounted in the forward wall 30 of housing 28, and located such that arm 44 may be swung to an extended position preventing removal of assembly 20 from cabinet 12, upon insertion and turning of a key in the lock 42.

Figure 3:
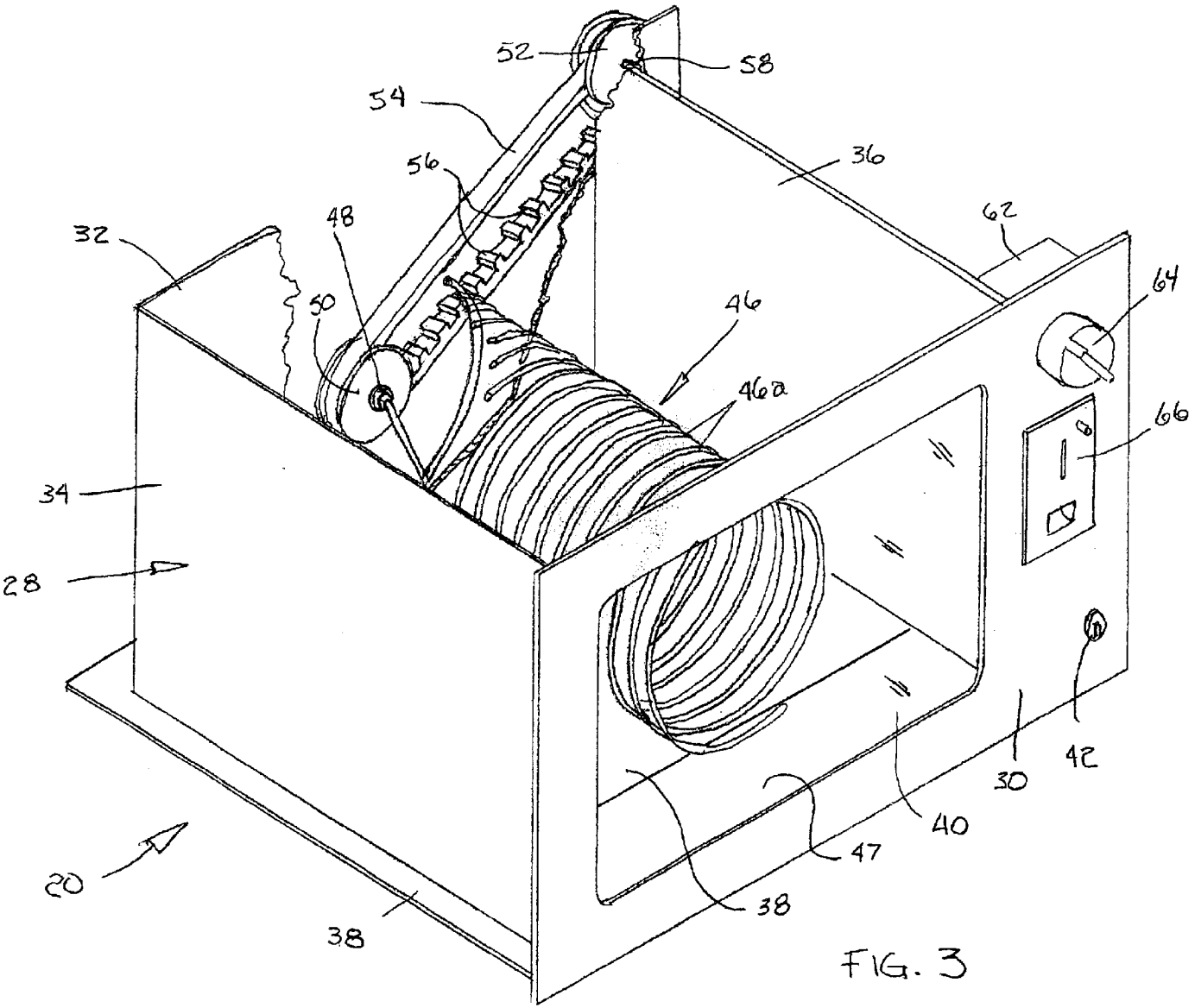
FIG. 3 is an enlarged perspective view of the dispensing apparatus of the invention, showing the top, front and left sides, with portions of side walls removed to show the components in more detail.

Referring now to FIG. 3, a large-diameter, cylindrical coil 46 is operably mounted within housing 22 on a rotatable shaft 48 projecting forwardly through the rearward wall 32. Coil 46 is suspended generally horizontally within housing 28 and is mounted for rotation about its longitudinal axis, coaxial with shaft 48. Coil 46 has a plurality of flights 46*a* that are separated a distance to hold an average newspaper therebetween, in the range of ½ to 2 inches. The diameter of coil 46 is sufficient to retain a standard size newspaper oriented in a vertical position generally parallel to the forward wall window 40. In this way, each flight or wind 46*a* of the coil 46 will slide a paper forwardly along the bottom wall 38 towards window 40. A slot 47 is formed at the forward end of bottom wall 38, at the forward end 46*b* of coil 46, so that the forwardmost newspaper will drop off the bottom wall 38 as the coil 46 is rotated. The dispenser chute 26 (shown in FIGS. 1 and 2) is located directly below the slot 47 and forward end 46*b* of coil 46 to receive and direct the dropped paper through the opening 24 in the cabinet 12.

Referring once again to FIG. 3, coil 46 and shaft 48 are mounted to a rotatable pulley 50 located on the exterior of rearward wall 32, such that rotation of pulley 50 will rotate coil 46 and advance a paper forwardly within housing 22. Pulley 50 is connected to a drive wheel 52 by a continuous-loop drive belt 54, in a conventional fashion, such that rotation of drive wheel 52 will cause rotation of pulley 50. Preferably, drive belt 54 has projections or teeth 56 along the inward face for engagement with corresponding teeth (not shown) on drive wheel 52 and pulley 50.

Drive wheel 52 is mounted on the rearward end of a rod 58, for rotation therewith. Rod 58 projects through a projecting flange 60 extending from the rearward edge of sidewall 36 and extends forwardly to a drive mechanism 62 mounted on forward wall 30 of housing 22 (as shown in FIG. 2). Drive mechanism 62 transmits the rotation of a knob 64 on the front of forward wall 30 to rod 58, drive wheel 52 and thereby to drive pulley 50 and coil 46. A coin mechanism 66 of known construction is connected to drive mechanism 62 to selectively lock the knob 64 and prevent dispensing of a paper. Drive mechanism 62 may be motorized if desired, to assist in the dispensing of the paper.

Whereas the invention has been shown and described in connection with the preferred embodiments thereof, many modifications, substitutions and additions may be made which are within the intended broad scope of the appended claims. For example, other types of printed media could be dispensed from the apparatus, including magazines and the like.

What is claimed is:

1. A newspaper dispenser for dispensing a single paper at a time, comprising:

a housing having a forward wall, rearward wall, opposing side walls and a bottom wall;

a generally cylindrical coil operably mounted within the housing for selective rotation on a longitudinal axis, said coil having a forward end, a rearward end and a plurality of winds therebetween for advancing a newspaper between the winds, said winds having a diameter sufficient to retain a newspaper in an upright position supported on the bottom wall, between a pair of winds;

said coil rearward end mounted on a shaft for rotation on its longitudinal axis, and oriented generally horizontally within the housing;

said shaft extending though said rearward wall and rotatably supported thereon with said coil located above the bottom wall, to slidably advance newspapers supported along the bottom wall upon rotation of the coil;

said bottom wall extending forwardly from the rearward wall a distance less than the length of the coil, to form a slot between a forward edge of the bottom wall and the forward wall of the housing, with the forward end of the coil extending beyond the forward edge of the bottom wall and over the slot;

selectively operable drive means connected to said shaft for selectively rotating the shaft and coil and thereby selectively dispensing a newspaper advanced by the coil.

2. A newspaper dispenser for dispensing a single paper at a time, comprising:

a housing having a forward wall, rearward wall, opposing side walls and a bottom;

said housing being selectively, removably mounted in a cabinet, with the housing forward wall generally flush with a forward wall of the cabinet;

a generally cylindrical coil operably mounted within the housing for selective rotation on a longitudinal axis, said coil having a forward end, a rearward end and a plurality of winds therebetween for advancing a newspaper between the winds:

said coil rearward end mounted on a shaft for rotation on its longitudinal axis, and oriented generally horizontally within the housing;

said shaft extending though said rearward wall and rotatable supported thereon with said coil located above the bottom wall, to advance newspapers along the bottom wall upon rotation of the coil;

said bottom wall extending forwardly from the rearward wall a distance less than the length of the coil, to form a slot between a forward edge of the bottom wall and the forward wall of the housing, with the forward end of the coil extending beyond the forward edge of the bottom wall and over the slot;

selectively operable drive means connected to said shaft for selectively rotating the shaft and coil and thereby selectively dispensing a newspaper advanced by the coil.

3. The newspaper dispenser of claim 2, wherein said cabinet forward wall has a first opening therein of a size for receiving the housing, and a second opening below the first opening for dispensing newspapers from the cabinet.

4. The newspaper dispenser of claim 3, wherein said drive means is connected to a coin mechanism of the type permitting operation of the drive means upon insertion of a predetermined amount of money in the coin mechanism.

5. The newspaper dispenser of claim 4, wherein said cabinet includes a chute located below said slot, for directing a newspaper dropped through the slot toe the cabinet second opening.

6. A newspaper dispenser for dispensing a single paper at a time, comprising:

a housing having a forward wall, rearward wall, opposing side walls and a bottom;

a generally cylindrical coil operably mounted within the housing for selective rotation on a longitudinal axis, said coil having a forward end, a rearward end and a plurality of winds therebetween for advancing a newspaper between the winds;

said coil rearward end mounted on a shaft for rotation on its longitudinal axis, and oriented generally horizontally within the housing;

at least one newspaper retained in a generally vertical orientation between a pair of coil winds and slidably supported on the floor, for advancement along the floor in a vertical orientation by the coil;

said shaft extending though said rearward wall and rotatably supported thereon with said coil located above the bottom wall;

said bottom wall extending forwardly from the rearward wall a distance less than the length of the coil, to form a slot between a forward edge of the bottom wall and the forward wall of the housing, with the forward end of the coil extending beyond the forward edge of the bottom wall and over the slot;

selectively operable drive means connected to said shaft for selectively rotating the shaft and coil and thereby selectively dispensing a newspaper advanced by the coil.

* * * * *